US008042930B2

(12) United States Patent
Burress et al.

(10) Patent No.: US 8,042,930 B2
(45) Date of Patent: Oct. 25, 2011

(54) METHOD OF SERVICING A DRUM MAINTENANCE UNIT (DMU) IN AN IMAGE GENERATING SYSTEM

(75) Inventors: Edward F. Burress, West Linn, OR (US); Michael Joel Edwards, Beaverton, OR (US); Joseph Benjamin Gault, Portland, OR (US); Michael Cameron Gordon, West Linn, OR (US); Devin Richard Bailly, West Linn, OR (US); Frank Alexander Weissig, Portland, OR (US); Barry Daniel Reeves, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 149 days.

(21) Appl. No.: 12/431,375

(22) Filed: Apr. 28, 2009

(65) Prior Publication Data

US 2010/0271451 A1 Oct. 28, 2010

Related U.S. Application Data

(62) Division of application No. 12/431,312, filed on Apr. 28, 2009, now Pat. No. 7,931,363.

(51) Int. Cl.
*B41J 2/01* (2006.01)
*B41J 2/175* (2006.01)
*B41J 2/165* (2006.01)

(52) U.S. Cl. ..... 347/103; 347/88; 347/29

(58) Field of Classification Search ..... 347/103, 347/88, 99, 21, 84–85, 89–91, 101, 7, 19, 347/49, 93, 36, 6
See application file for complete search history.

(56) References Cited

U.S. PATENT DOCUMENTS

| | | | | | |
|---|---|---|---|---|---|
| 4,429,990 | A * | 2/1984 | Tamary | 399/325 |
| 4,449,476 | A * | 5/1984 | Voswinckel et al. | 118/674 |
| 4,949,667 | A * | 8/1990 | Yoshida et al. | 118/60 |
| 5,345,296 | A * | 9/1994 | Wellings | 399/238 |
| 5,365,261 | A * | 11/1994 | Ozawa et al. | 347/103 |
| 6,016,409 | A | 1/2000 | Beard et al. | |
| 6,029,036 | A * | 2/2000 | Itaya et al. | 399/239 |
| 6,082,851 | A * | 7/2000 | Shihoh et al. | 347/85 |
| 6,173,128 | B1 | 1/2001 | Saber et al. | |
| 6,526,244 | B1 * | 2/2003 | Viturro et al. | 399/237 |
| 7,036,920 | B2 | 5/2006 | Rousseau et al. | |
| 7,114,803 | B2 | 10/2006 | Rousseau | |
| 7,393,312 | B2 | 7/2008 | Rousseau | |
| 2001/0022908 | A1 * | 9/2001 | Mikita | 399/324 |
| 2005/0179720 | A1 * | 8/2005 | Iwasaki et al. | 347/19 |
| 2007/0126836 | A1 * | 6/2007 | Masuyama et al. | 347/103 |
| 2007/0146461 | A1 * | 6/2007 | Islam et al. | 347/103 |
| 2008/0181625 | A1 | 7/2008 | Moodie et al. | |
| 2009/0220701 | A1 * | 9/2009 | Furukawa et al. | 427/428.01 |

* cited by examiner

*Primary Examiner* — Stephen Meier
*Assistant Examiner* — Leonard S Liang
(74) *Attorney, Agent, or Firm* — Maginot, Moore & Beck LLP

(57) ABSTRACT

A method of servicing a customer replaceable unit of an imaging device includes providing a customer replaceable unit configured for insertion and removal from an imaging device. The customer replaceable unit includes at least an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from the applicator to the reservoir, and a memory including operational data for the customer replaceable unit. A maintenance procedure is then performed on the customer replaceable unit.

20 Claims, 13 Drawing Sheets

METHOD OF SERVICING A DRUM MAINTENANCE UNIT (DMU) IN AN IMAGE GENERATING SYSTEM

CROSS-REFERENCE TO RELATED APPLICATIONS

This application is a divisional of U.S. patent application Ser. No. 12/431,312, entitled "Open Loop Oil Delivery System" to Burress et al., filed concurrently herewith, the entire disclosure of which is expressly incorporated by reference herein.

TECHNICAL FIELD

This disclosure relates generally to imaging devices having intermediate transfer surfaces, and, in particular, to maintenance systems for such intermediate transfer surfaces.

BACKGROUND

In solid ink imaging systems having intermediate members, ink is loaded into the system in a solid form, either as pellets or as ink sticks, and transported through a feed chute by a feed mechanism for delivery to a heater assembly. A heater plate in the heater assembly melts the solid ink impinging on the plate into a liquid that is delivered to a print head for jetting onto an intermediate transfer member which may be in the form of a rotating drum, for example. In the print head, the liquid ink is typically maintained at a temperature that enables the ink to be ejected by the printing elements in the print head, but that preserves sufficient tackiness for the ink to adhere to the intermediate transfer drum. In some cases, however, the tackiness of the liquid ink may cause a portion of the ink to remain on the drum after the image is transferred onto the media sheet which may later degrade other images formed on the drum.

To address the accumulation of ink on a transfer drum, solid ink imaging systems may be provided with a drum maintenance unit (DMU). In solid ink imaging systems, the DMU is configured to 1) lubricate the image receiving surface of the drum with a very thin, uniform layer of release agent (e.g., Silicone oil) before each print cycle, and 2) remove and store any excess oil, ink and debris from the surface of the drum after each print cycle. Previously known DMU's typically included a reservoir for holding a suitable release agent and capillary forces delivered the release agent to an applicator as needed for applying the release agent to the surface of the drum.

SUMMARY

According to one embodiment, a method of servicing a customer replaceable unit of an imaging device includes providing a customer replaceable unit configured for insertion and removal from an imaging device. The customer replaceable unit includes at least an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from the applicator to the reservoir, and a memory including operational data for the customer replaceable unit. A maintenance procedure is then performed on the customer replaceable unit.

In another embodiment, a method of operating an imaging device includes the removal of a first drum maintenance unit from an imaging device. The first drum maintenance unit includes at least an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from the applicator to the reservoir, and a memory including operational data for the customer replaceable unit. A second drum maintenance unit is then inserted into the imaging device. The second drum maintenance unit is different than the first drum maintenance unit.

In yet another embodiment, a method of maintaining a drum maintenance unit of an imaging device includes providing at least one component of a drum maintenance unit of an imaging device. The at least one component of the drum maintenance unit comprising at least one of an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from the applicator to the reservoir, and a memory including operational data for the customer replaceable unit. The at least one component is installed in a housing of the drum maintenance unit.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
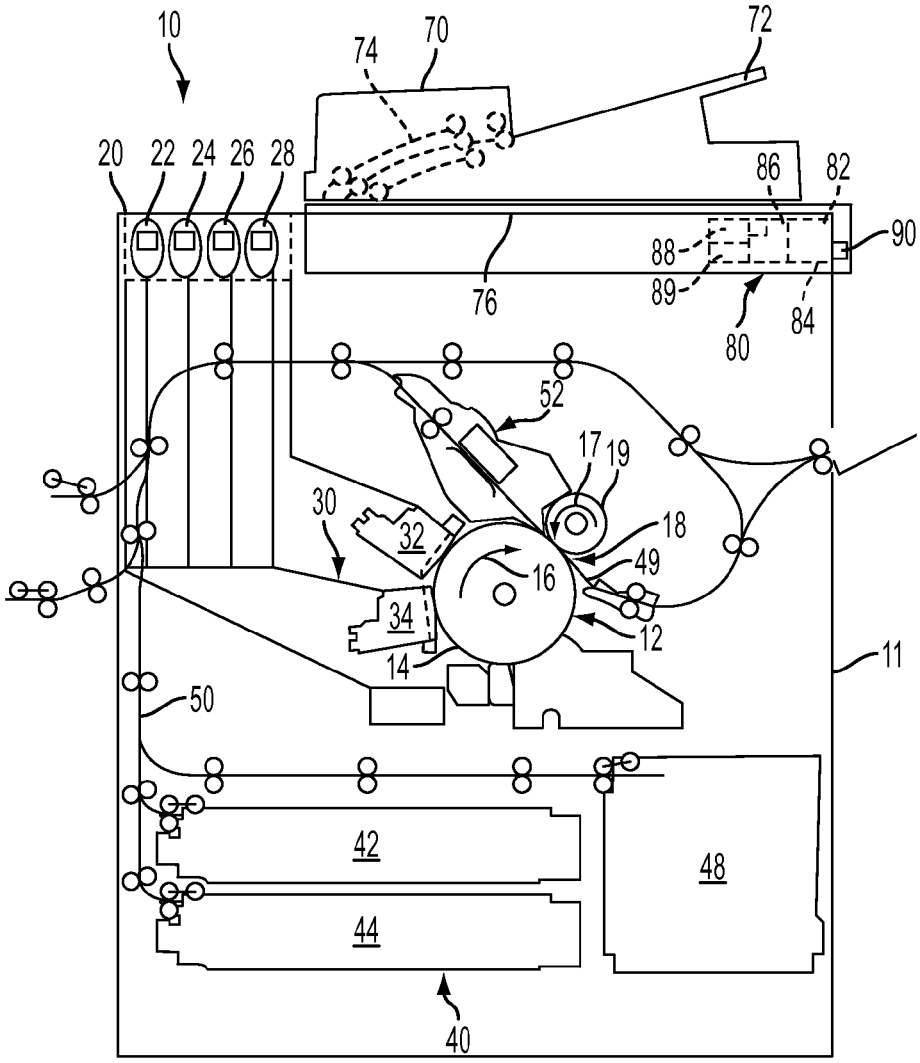
FIG. 1 is a schematic diagram of an embodiment of an ink jet printing apparatus.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. As used herein, the term "consumable" refers to anything that is used or consumed by an imaging device during operations, such as print media, marking material, cleaning fluid, and the like. An image generally may include information in electronic form which is to be rendered on the print media by the image forming device and may include text, graphics, pictures, and the like. The operation of applying images to print media, for example, graphics, text, photographs, etc., is generally referred to herein as printing or marking.

Referring now to FIG. 1, an embodiment of an imaging device 10 of the present disclosure, is depicted. As illustrated, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media.

The imaging device 10 also includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. The ink delivery system is configured to supply ink in liquid form to a printhead system 30 including at least one printhead assembly 32. Since the imaging device 10 is a high-speed, or high throughput, multicolor device, the printhead system 30 includes multicolor ink printhead assemblies and a plural number (e.g. four (4)) of separate printhead assemblies (32, 34 shown in FIG. 1).

In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the printhead assemblies 32, 34. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead assemblies 32, 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 along supply path 50 in timed registration with image formation on the surface 14. Finally, the image is transferred from the surface 14 and fixedly fused to the copy sheet within the transfix nip 18.

Figure 2:
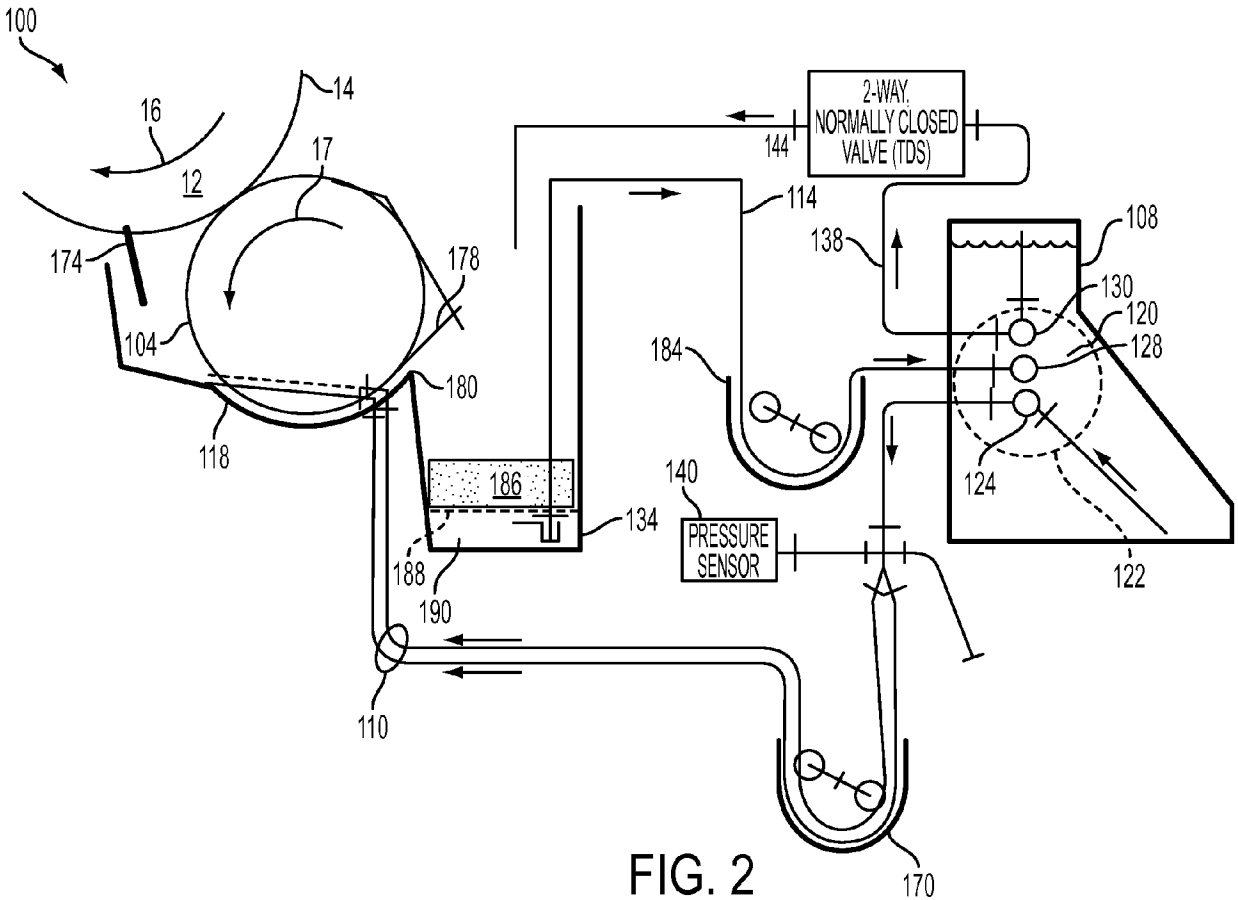
FIG. 2 is a schematic diagram of a drum maintenance unit for use in the imaging device of FIG. 1.

To facilitate transfer of an ink image from the drum to a recording medium, a drum maintenance system, also referred to as a drum maintenance unit (DMU), is provided to apply release agent to the surface of the print drum before ink is ejected onto the print drum. The release agent provides a thin layer on which an image is formed so the image does not adhere to the print drum. The release agent is typically silicone oil although any suitable release agent may be used. As depicted in FIG. 2, the DMU 100 includes an applicator 104 for applying the release agent to the drum and an oil reservoir 108 that holds a supply of release agent. As explained in more detail below, the DMU includes a delivery fluid path 110 that directs release agent from the reservoir to the applicator, and a recirculation fluid path 114 that directs excess release agent delivered to the applicator back to the reservoir.

As mentioned, one difficulty faced in drum maintenance systems that utilize an applicator for applying release agent to a transfer surface is uneven saturation of the applicator which may result in potential print quality variation and problems. Previously known drum maintenance systems utilized a closed loop system in an effort to maintain consistent oil saturation of the applicator. For example, some previously known drum maintenance systems supplied release agent to the applicator based on input received from saturation sensors associated with the applicator. Oil saturation sensing of an applicator, however, is prohibitive due to ink and debris buildup in the drum maintenance system over time. That buildup is a byproduct of the print process and results in changes to the characteristics of the applicator and system which potentially may vary from printer-to-printer.

Figure 3:
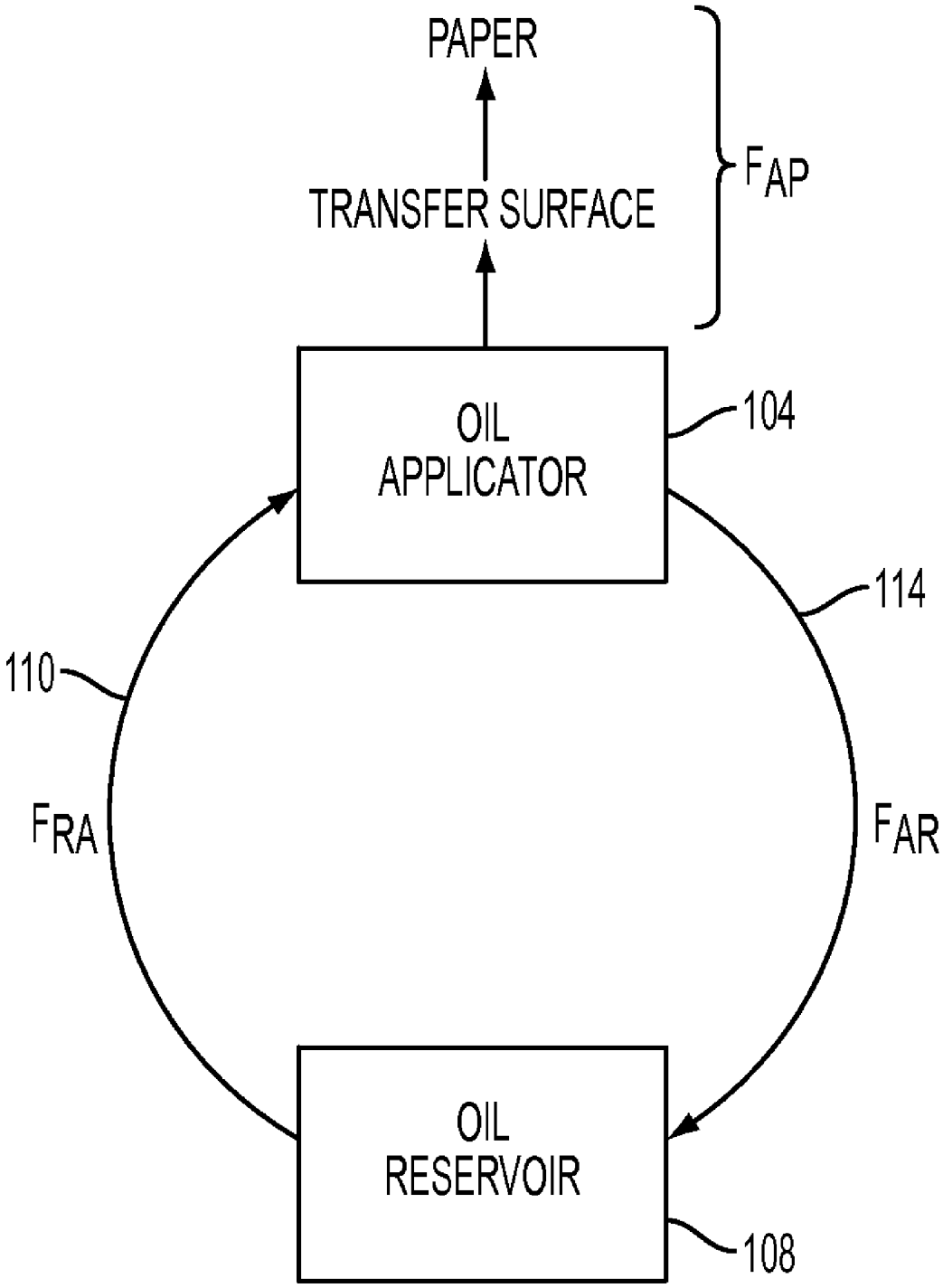
FIG. 3 is a schematic diagram of an open loop oil delivery process.

As an alternative to using a closed loop oil delivery process as in the prior art, the present disclosure proposes the use of an open loop oil delivery process (OLOD) for the DMU. Referring now to FIG. 3, in an OLOD process, the oil release agent is pumped to the applicator 104 along the delivery fluid path 110 at a flow rate $F_{RA}$ faster than the rate $F_{AP}$ oil leaves the applicator at the system's highest throughput resulting in excess of oil being delivered to the applicator thereby keeping the applicator fully saturated during operation. Excess oil delivered to the applicator 104 is pumped back to the reservoir 108 along the recirculation fluid path 114 at a flow rate $F_{AR}$ faster than oil is pumped to the applicator. This results in regularly pumping air through the recirculation path after all loose oil has been pumped into the reservoir which helps to maintain the recirculation fluid path clear of debris that may clog the fluid path.

Using an OLOD process, there is very little variation in oil saturation of the applicator over time. In addition, oil saturation sensing of the applicator is not necessary because the applicator is kept fully saturated. Another benefit of using an OLOD process is that loose oil does not buildup in the DMU because excess oil is actively pumped back into the reservoir. A large storage capacity in the DMU for oil, ink, and debris buildup in the DMU over life is not necessary because excess oil and ink removed from the drum is pumped into the reservoir.

Referring again to FIG. 2, a schematic diagram of an embodiment of a DMU configured to implement an OLOD process is illustrated. As depicted, the DMU 100 includes a release agent applicator 104 in the form of a roller which is configured to apply a release agent, such as silicon oil to the transfer surface 14 as it rotates. In embodiments, the roller 104 is formed from an absorbent material, such as extruded polyurethane foam. The polyurethane foam has an oil retention capacity and a capillary height that enables the roller to retain fluid even when fully saturated with release agent fluid. To facilitate saturation of the roller with the release agent, the roller 104 is positioned over a reclaim receptacle 118 in the form of a tub or trough, referred to herein as a reclaim trough. In one embodiment, the reclaim trough 118 has a bottom surface that follows the cylindrical profile of the lower portion of the roller. The roller 104 is positioned with respect to the reclaim trough 118 so that it is partially submerged in the release agent received therein. The bottom surface of the trough may include surface features (not shown), such as chevrons, that protrude from the surface and shaped or angled to direct oil from the outer edges of the roller toward the center.

The reclaim trough 118 is configured to receive release agent from a release agent reservoir 108. In the embodiment of FIG. 2, the reservoir 108 comprises a plastic, blow-molded bottle or tube having an opening 122 at one end that enables a predetermined amount of release agent to be loaded into the reservoir. Sealed over the opening 122 of the reservoir is an end cap 120. The end cap 120 may be sealed to the opening in any suitable manner such as by spin welding, gluing, or the like. The end cap 120 has three fluidic pass-through openings 124, 128, 130. Three tubes are connected to the openings on the outside of the end cap using barbed fittings, for example, including a delivery tube 110 that fluidly connects the reservoir 108 to the reclaim area 118, a sump tube 114 (recirculation tube) that fluidly connects the reservoir 108 to the sump 134 (explained below), and a vent tube 138 fluidly connects the interior of the reservoir 108 to atmosphere to relieve any positive or negative pressure developed in the reservoir. The vent tube includes a solenoid valve 144 that is normally closed to prevent any oil leaks during shipping and customer handling. The solenoid valve 144 is opened as oil is being pumped into and out of the oil reservoir to allow the reservoir to vent to atmospheric pressure. In the exemplary embodiment of FIG. 3, the delivery tube 110 begins as a single tube extending from the reservoir 108 and is divided into two tubes prior to reaching the reclaim trough 118. These two tubes supply oil to opposite ends of the trough 118 so that an equal amount of oil is delivered to both ends of the roller which prevents uneven oil saturation over the length of the roller.

Figure 4A:
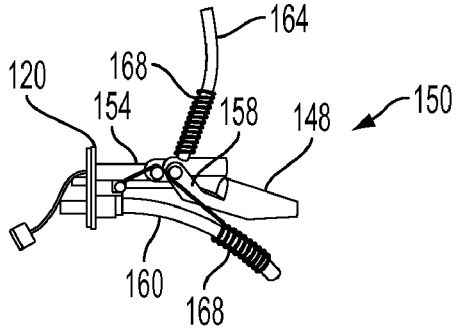
FIG. 4A-C depict an embodiment of an end cap sensor assembly for use in the DMU of FIG. 2.
Figure 4B:
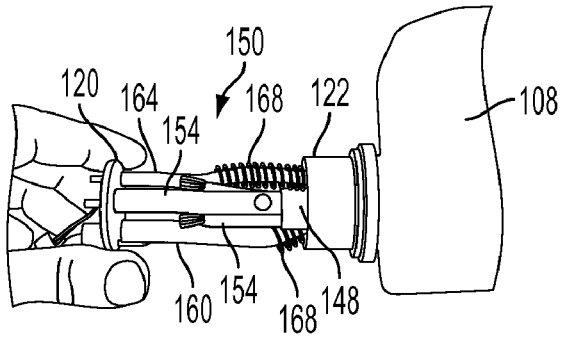
Figure 4C:
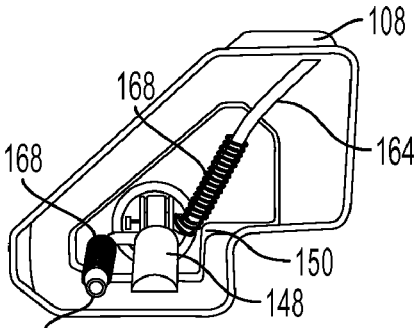

The reservoir 108 includes a low level sensor that is configured to generate a low level signal when the oil level in the reservoir reaches a predetermined low oil level. In one embodiment, the low level sensor comprises a float low level sensor that is incorporated into the end cap of the reservoir. Referring to FIGS. 4A-C, an embodiment of an end cap sensor assembly 150 is depicted. As explained below, the end cap sensor assembly 150 provides three fluidic pass-throughs 124, 128, 130, (shown in FIG. 2) a float sensor 148, and the sealing lid 120 for the oil reservoir 108 using a single set of parts and requires only one opening 122 in the reservoir.

The float low level sensor 148 of the end cap sensor assembly 150 utilizes a reed switch (not shown) potted inside a proboscis 154 which extends from the inside of the end cap into the reservoir. Alternatively, a hall effect switch may be used. A float 148 made from a buoyant material less dense than the release agent fluid is attached to a pivot shaft 158 on the proboscis 154. A magnet (not shown) is molded into the float 148 and covered with epoxy. Alternatively, the magnet could be pressed in or adhered to the float. When the reservoir is full, the float 148 is in the up position. The proximity of the magnet to the reed switch causes the reed switch to be closed and the circuit complete. Once the level of the fluid passes below the float low level sensor, the float 148 drops away from the reed switch, and the switch and the circuit open to indicate that the low level has been reached.

Referring again to FIGS. 2 and 4, extending from the interior of the cap into the interior of the reservoir are an uptake tube 160 and a vent tube 164. The uptake tube 160 is attached to the delivery opening 124 at one end and is constrained to the floor of the reservoir 108 at the other end to maximize the amount of oil that can be drawn from the reservoir. The vent tube 164 is attached to the vent opening 130 at one end and is constrained to the ceiling of the reservoir 108 at the other end. In one embodiment, the vent tube 164 and uptake tube 160 are constrained in their required positions using two custom wire formed parts 168 that resemble a torsion spring combined with a compression spring. The torsion coil slides over a cruciform on the proboscis of the end cap plate. The vent tube and the uptake tube slide through the compression coils of their respective parts. While the tubes are assembled into the springs, the springs can be deflected such that the torsion coils open up and the cross section of the whole assembly is small enough to be inserted into the opening of the reservoir. Once installed into the reservoir, the springs relax toward their static state, and force the tubes to their required positions.

Referring again to FIG. 2, a release agent delivery system 170 is configured to pump release agent from the reservoir through the tubes 110 to the reclaim area 118 at a predetermined rate of flow $F_{RA}$ that is intended to keep the applicator 104 fully saturated during operation. According to the OLOD process, the delivery system 170 is configured to pump the release agent to the reclaim area at a flow rate $F_{RA}$ that is greater than the rate $F_{AP}$ that release agent leaves the applicator to the transfer drum surface and subsequently to print media brought into contact with the drum, also referred to as the applicator-to-paper flow rate, so that excess oil is delivered to the roller to keep the applicator fully saturated during use. The rate $F_{AP}$ that release agent leaves applicator at the system's highest throughput may be predetermined or derived during use. The delivery flow rate $F_{RA}$ may be set to substantially any suitable rate that is greater than the applicator to paper flow rate.

In one embodiment, the delivery system 170 includes a peristaltic delivery pump. The peristaltic delivery pump 170 includes a pair of rotors through which the two tubes 110 that connect the reservoir to each end of the applicator are extended. The rotation of the rotors under the driving force of a motor (not shown) squeezes the delivery conduits in a delivery direction toward the reclaim trough. As the release agent is pushed through the tubes 110 in the delivery direction, release agent is being pulled into the tubes from the reservoir. Driving two tubes driven through one peristaltic pump insures equal oil delivery to both end of the applicator roller regardless of the effects of gravity on a tilted system.

In operation, as the transfer drum 12 rotates in the direction 16, the roller 104 is driven to rotate in the direction 17 by frictional contact with the transfer drum surface 14 and applies the release agent to the drum surface 14. As the roller 104 rotates, the point of contact on the roller 104 is continuously moving such that a fresh portion of the roller 104 is continuously contacting the drum surface 14 to apply the release agent. A metering blade 174 may be positioned to meter release agent applied to the drum surface 14 by the roller 104. The metering blade 174 may be formed of an elastomeric material such as urethane supported on an elongated metal support bracket (not shown). The metering blade 174 helps insure that a uniform thickness of the release agent is present across the width of the drum surface 14. In addition, the metering blade 174 is positioned above the reclaim trough 118 so that excess oil metered from the drum surface 14 by blade 174 is diverted down the metering blade 174 back to the reclaim trough 118.

The DMU 100 may also include a cleaning blade 178 that is positioned with respect to the drum surface 14 to scrape oil and debris, such as paper fibers, untransfixed ink pixels and the like, from the surface 14 of the drum prior to the drum being contacted by the roller 104 and metering blade 174. In particular, after an image is fixed onto a print media, the portion of the drum upon which the image was formed is contacted by the cleaning blade 178. The cleaning blade 178 may be formed of an elastomeric material and is positioned above the reclaim trough 118 so that that oil and debris scraped off of the drum surface by the cleaning blade is directed to the reclaim trough as well.

The reclaim trough 118 is capable of holding a limited amount of release agent. The volume of oil held in the reclaim trough is set to be the smallest amount that keeps the roller fully saturated. The reclaim trough volume is minimized to limit the potential for oil spills when the DMU is tilted. The volume of the reclaim trough is set by the height of the overflow wall that allows oil to flow into the sump area. Once the reclaim trough 118 has been filled with release agent received from the reservoir as well as release agent and debris diverted into the reclaim trough by the metering blade, excess release agent flows over the edge 180 of the reclaim trough 118 and is captured in sump 134 prior to recirculation to the reservoir 108. Sump 134 is fluidly coupled to the reservoir 108 by at least one flexible conduit or tube 114. A sump pump 184 is configured to pump release agent from the sump 134 through the sump tube 114 to the reservoir 108 at a predetermined rate of flow $F_{AR}$. In one embodiment, the sump pump comprises a peristaltic pump although any suitable pumping system or method may be used that enables the release agent to be pumped to the reservoir at a desired flow rate.

Referring again to FIG. 2, sump 134 may include a filter that ink, oil, and debris must pass through prior to being recirculated into the oil reservoir. The purpose of the filter is to remove any particles that are large enough to cause a clog in the fluid path, e.g. sump tube. In one embodiment, the filter includes a top layer 186 of reticulated foam, a middle layer 188 of perforated sheet metal, and a bottom layer 190 of foam to seal around the front edge and sides of the perforated sheet metal 188. The perforated sheet metal 188 covers approximately two-thirds of the sump area in such a way that if the filter itself becomes clogged over time, there will be an open area, which will serve as a filter bypass. Because the used release agent is being pumped back to the reservoir from the sump, filtration of the used release agent is actively driven as the oil is pumped from the sump into the reservoir. Also, the reservoir acts as settling area. The ink and debris that is entrained in the oil that has returned from the sump will settle on the bottom of the reservoir.

Figure 5:
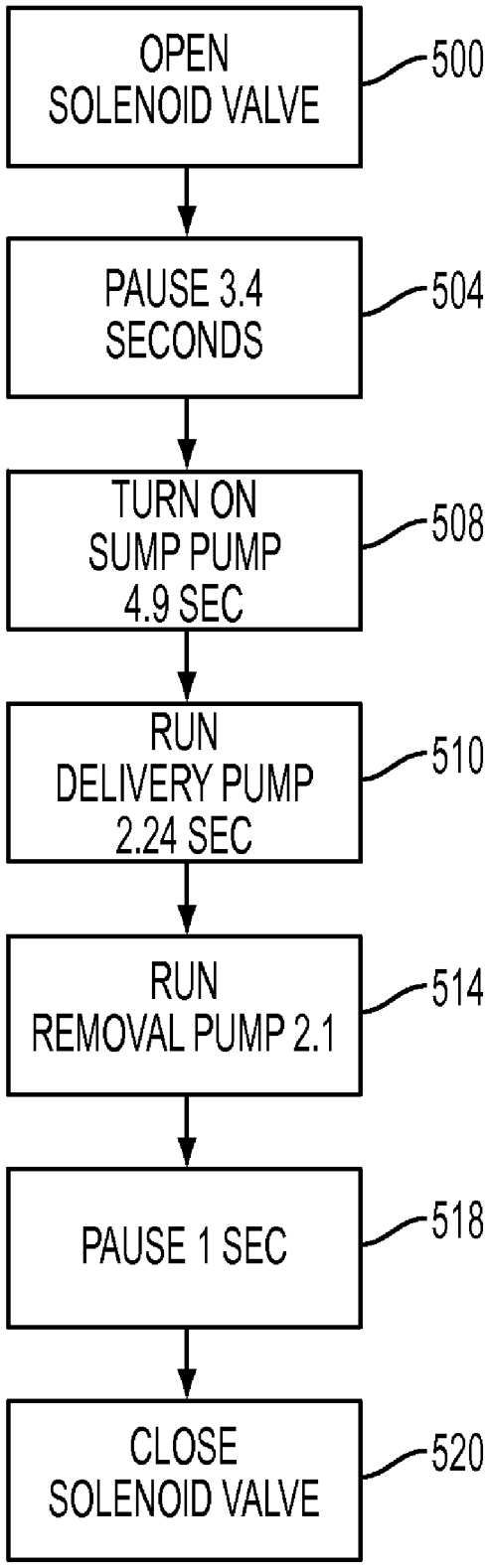
FIG. 5 is a flowchart of a pump cycle for the DMU of FIG. 2.

During operation of the DMU, a pump cycle is performed at predetermined intervals to both deliver silicone oil to the application roller and to remove used oil from the sump and return it to the reservoir to be held until it is recycled and used again. In one embodiment, a pump cycle is performed every 20 pages printed although a pump cycle may be performed at any suitable interval. Referring to FIG. 5, a flowchart depicting an embodiment of a pump cycle is illustrated. As depicted, a pump cycle begins with the opening of the solenoid valve (block 500). The solenoid valve is open for a predetermined time (block 504), e.g., 3.4 seconds in the exemplary embodiment although pause may be any suitable length, before running the sump pump 184 for a predetermined length of time, e.g., 4 seconds, (block 508). The sump pump is stopped and the delivery pump is then ran for a predetermined period of time, e.g., 2.24 seconds, (block 510). The delivery pump is then stopped and the sump pump is run again for another predetermined amount of time, e.g., 2.1 seconds, (block 514). The sump pump is stopped and the solenoid valve is then closed (block 520) after a pause, e.g. 1 second, (block 518) to allow any pressure build up in the reservoir to vent to atmosphere.

As seen in FIG. 5, the sump pump 184 is run before and after the delivery pump. The reason the sump pump is run before and after the delivery pump is because the delivery pump should not be run if the sump pump is not working because excessive free oil could end up in the roller recharge area, increasing the risk of an oil spill that would create a poor customer experience and potentially dangerous situation. If the sump pump is shorted, a removal pump over current fault will be immediately raised and the DMU will be unusable. Therefore, the delivery pump will never run its part of the cycle because the fault is raised first. If the delivery pump is shorted, a delivery pump over current fault will be raised and the DMU will be unusable. If the sump pump is stalled, the delivery pump will not be run. If either pump is stalled for a total of 3000 pages, for example, a sump pump or delivery pump stall fault will be raised and the DMU will be unusable.

Figure 6A:
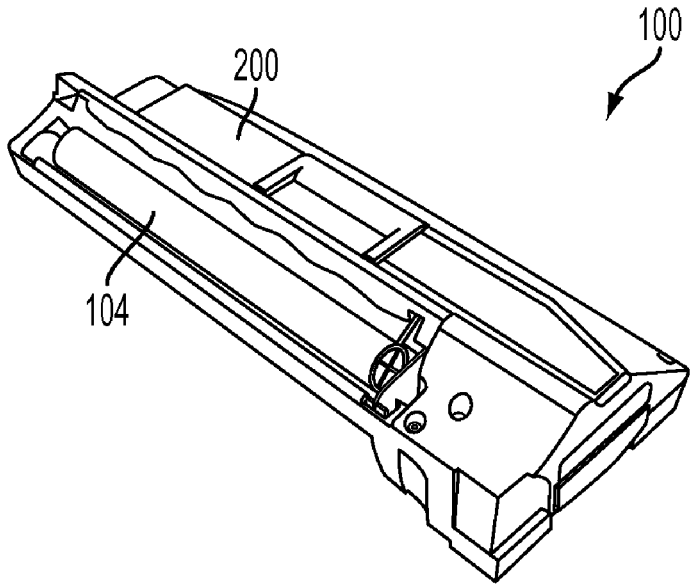
FIG. 6A is a perspective view of the DMU of FIG. 2.
Figure 6B:
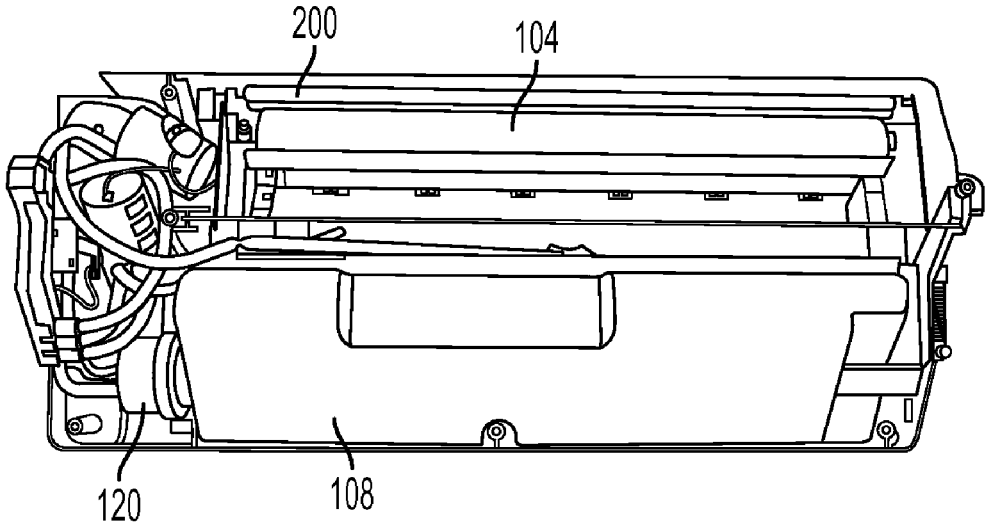
FIG. 6B is a top view of the DMU of FIG. 6A with the cover removed.

The DMU 100 described above (with reference to FIG. 2) may comprise a customer replaceable unit (CRU). As used herein, a CRU is a self-contained, modular unit which includes all or most of the components necessary to perform a specific task within the imaging device enclosed in a module housing that enables the CRU to be inserted and removed from the imaging device as a functional self-contained unit. As best seen in FIGS. 6A and 16B, the DMU 100 includes a housing 200 in which the components of the DMU, such as the applicator 104, end cap 120 and oil reservoir 108 (as well as other components described above in connection with the schematic diagram of the DMU depicted in FIG. 4) are enclosed. The DMU housing 200, including all of the internal components, is configured for insertion into and removal from the imaging device 10 as a self-contained unit.

As a CRU, the DMU 100 has an expected lifetime, or useful life, that corresponds to the amount of oil loaded in the DMU reservoir 108. In the exemplary embodiment, the useful life may be between approximately 10,000 and 30,000 depending on factors such as oil usage and the amount of oil in the reservoir. When the DMU has reached the end of its useful life, i.e. is out of oil, the DMU may be removed from its location or slot in the imaging device and replaced with a new DMU. To alert an operator that the DMU should be replaced, the DMU includes a "customer replaceable unit monitor," or CRUM. As described more fully in U.S. Pat. No. 6,016,409, which is hereby incorporated by reference herein in its entirety, the CRUM of the DMU contains memory that stores information pertaining to the DMU.

In one embodiment, the DMU CRUM comprises a non-volatile memory device, such as an EEPROM, that is incorporated into the housing of the DMU. The EEPROM may be implemented in a circuit board (not shown), for example, that is electrically connected to the imaging device controller when the DMU is fully inserted into the imaging device. The EEPROM of the DMU includes a plurality of dedicated memory locations for storing information pertaining to the DMU such as, for example, the mass of silicone oil initially filled into the tank at the time of manufacture (born mass), the estimated current mass of silicone oil in the reservoir (current mass), the total amount of media area that has been printed while that DMU has been installed, the total amount of media area that has been covered by ink, the serial number of the DMU, the date of manufacture, the date of first use, the calculated oil consumption rates for blank media and ink covered media, the float low level sensor calibrated trip mass (explained below), and the current state of the float level sensor (explained below). In addition, the EEPROM includes a memory location for an end of life (EOL) page countdown ("EOL counter") that is decremented as prints are made (explained below).

According to one aspect of the present disclosure, mass is decremented in three different stages throughout the DMU's life: Stage 1—Open loop decrement based on media size and ink coverage; Stage 2—the low level sensor trips when the fluid level drops low enough and the mass decrement rates are refined; and Stage 3—a last drop detector determines that the reservoir is empty and a hard countdown begins. As explained below, the last drop detector utilizes the pressure transducer to determine when the reservoir is empty by measuring the pressure drop from ambient due to pumping. This drop is greater when pumping liquid than when pumping air.

FIGS. 7A-7D show a flowchart of a software algorithm that has been developed to estimate the remaining life of the DMU. Prior to first use, the current mass of oil in the DMU is set to an initial oil mass value, e.g. born mass (block 1600), and the number of pump cycles performed (p) and the number of pages printed (n) are each set to zero (block 1604). With each print made (block 1608), a small amount of oil exits the DMU as it is absorbed by the printed page and the ink on the page. In the initial mass decrementing stage, the amount of oil that is decremented from the current mass value in the memory device is calculated by multiplying the area of blank media by a predetermined oil consumption rate for blank media and multiplying the area of media covered in ink by a predetermined oil consumption rate for media covered in ink (block 1620). The mass decrements for each print are calculated by the print engine firmware (block 624) and the current mass is updated by subtracting the page mass calculated by the print engine (block 628). The current mass is compared to threshold values, e.g., 150 g (block 630) and 0 g (block 634), to detect "oil low" and "oil very low" conditions, respectively. If the current mass is less than 150 g, an "oil low" fault is generated (block 632). If the current mass is calculated to be less than or equal to zero, a check is made to determine whether the oil very low fault has been generated (block 636). In one embodiment, the print engine checks every ten seconds, for example, to see if ten prints have been made since the last time the engine RAM was flushed to the DMU memory. If it has been at least ten prints, the engine writes the updated current mass and information to the EEPROM. The mass continues to decrement in this open-loop way until the float low level sensor trips (block 1618).

When the float is tripped, the current mass is changed to the float low level sensor calibrated trip mass (block 622). If the current calculated mass is 400 grams greater than the low level sensor calibrated trip mass, a "level sensor early" fault is raised and the machine is disabled (not shown). The intent of this feature is to detect catastrophic leaks and alert service. Also when the float trips, the refined oil consumption rates are calculated by the print engine (block 1618) and written to the EEPROM. For example, since it is known how much oil has been used at this point and how much paper and ink has been used at this point (block 1610), the rate of oil consumption can be calculated given the assumption that the relative value of oil consumption between inked areas and blank areas is the same between all units. For example, oil is consumed on inked areas 1.7 times faster than oil is consumed on blank areas. Once the refined decrement rates have been calculated, oil mass may be decremented using the refined rates (block 622).

Oil continues to decrement at the refined rates until one of two things happens: either the mass decrements to zero (block 1634) or last drop detector conditions are met. Normally last drop detect happens first. In one embodiment, a pressure transducer may be used as a last drop detector. For example, a pressure transducer may be used to detect when the reservoir is empty and the pumps are no longer moving liquid but instead are moving air (could be any gas). The way this is accomplished is by exploiting the physics explained by Pouiseuille's Law for flow in a pipe:

$$\Phi = \frac{\pi}{2\eta}\frac{|\Delta P|}{\Delta x}\int_0^R (rR^2 - r^3)dr = \frac{|\Delta P|\pi R^4}{8\eta\Delta x}$$

Simply stated, given constant tube radius and length and assuming constant flow rate and incompressible fluid, the higher the viscosity of a fluid, the higher the pressure that will develop during movement of the fluid in a tube. Referring again to FIG. 2, a pressure transducer 140 is placed upstream of the pump 170 in between the reservoir 108 and the pump 170. The pages printed value (n) is incremented for each printed page (block 740). As mentioned, a pump cycle may be run every 20 pages printed (n=20, block 744). A voltage is read from the pressure transducer during each pump cycle at ambient conditions (block 746) and when the pump is running (block 748). In a last drop detection routine, the voltage while pumping Vp is subtracted from the voltage while ambient Va (block 750). The difference between the two is the voltage delta ΔV. When the liquid runs out and air is pumped, the voltage delta ΔV approaches zero. At this point, a check is made to detect a clog in the oil delivery line. If there is a clog in the delivery line, the volume that the delivery pump is sucking from becomes extremely small compared to the reservoir and unvented. Therefore, the pressure drop from the delivery pump running increases greatly in magnitude. If the change in voltage on the pressure transducer is greater than 300 mV for five pump cycles in a row (block 752), a fault is raised for a clog in the delivery line and the DMU becomes unusable.

The last drop detection algorithm to determine if the reservoir is empty is as follows: If the average of the voltage deltas of the last 10 pump cycles is 15 mV or less (block 756), the reservoir is considered empty (block 758). The last drop detection algorithm is not enabled until either the float of the low level sensor has dropped or the current calculated mass is 300 grams or less (block 754). This is to prevent spurious last drop detections. If the conditions for enabling the last drop detection algorithm are not active or if the last drop detection algorithm has not determined the reservoir is empty, then n is reset to zero. Once the empty conditions of the algorithm are met, the "Oil Very Low" fault is raised and the end of life page countdown begins.

Figure 8:
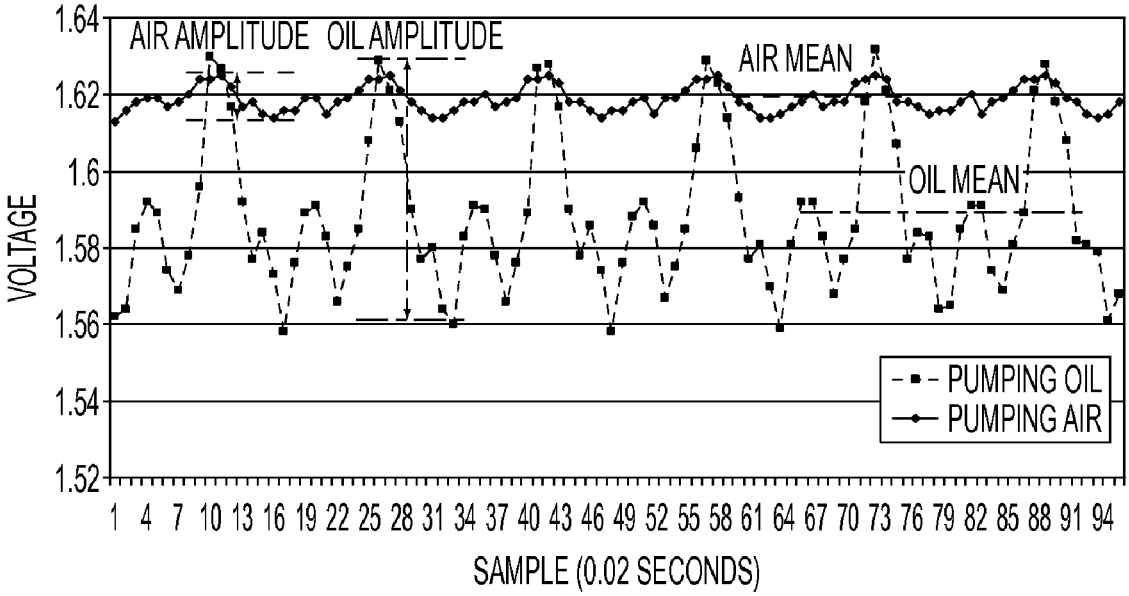
FIG. 8 is a graph of the pressure change over time for a DMU delivery pump pumping oil and pumping air.

In an alternative embodiment, the pressure sensor may be used for last drop detection by monitoring the amplitude of the cyclic pressure variation during a pump cycle. FIG. 8 is a graph of the voltage response from the pressure sensor over time when the delivery pump is pumping oil and when the delivery pump is pumping air. As seen in FIG. 8, the amplitude of the cyclic pressure variation is much higher when pumping oil than when pumping air. Because of the cyclic nature of the peristaltic pump and the arrangement of the rollers, there are points in the cycle when little or no negative pressure is created whether air or oil is being pumped. When oil is being pumped, the periodic pressure drop is much greater.

Figure 7A:
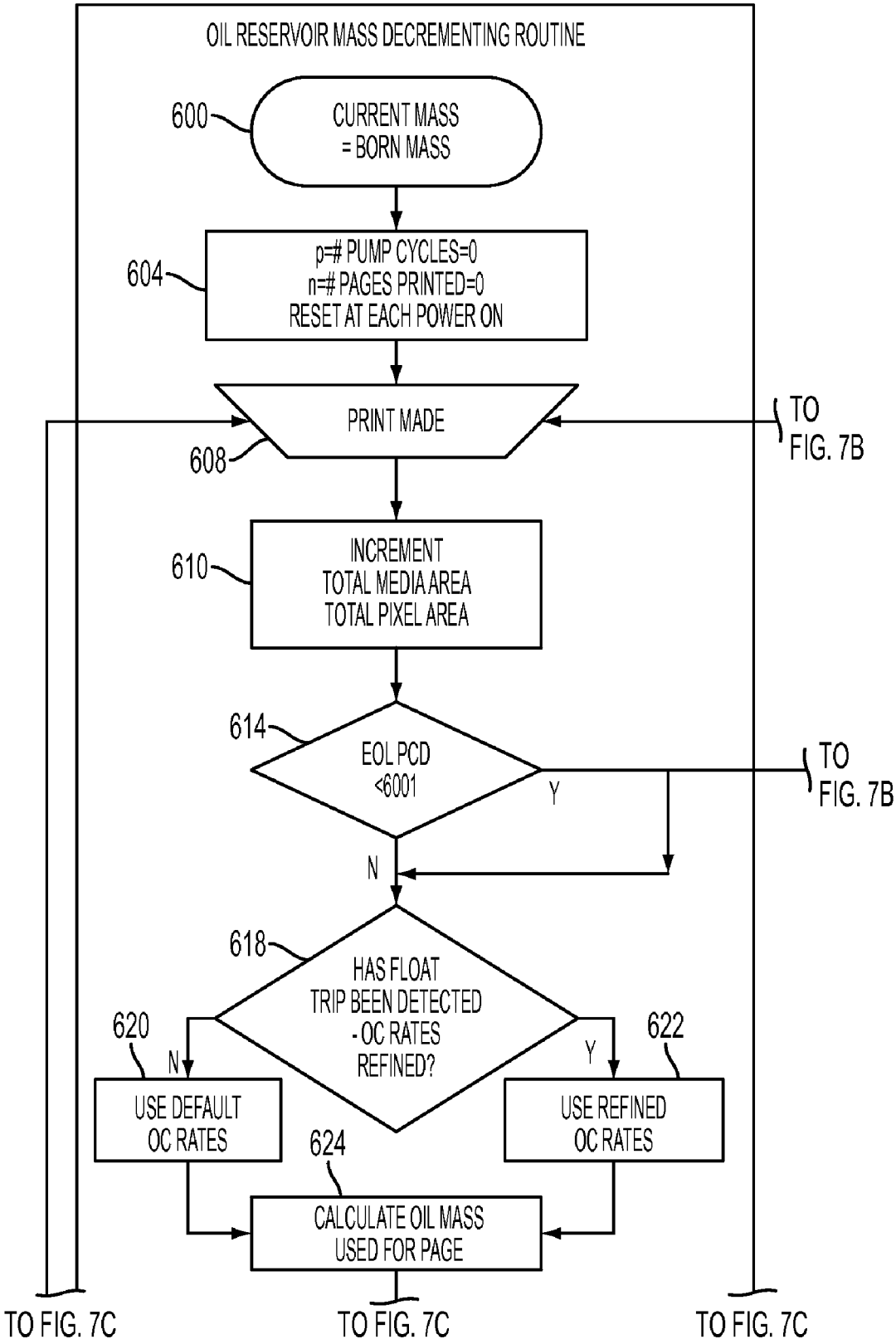
FIGS. 7A-7D show a flowchart of a life sensing algorithm for use with the DMU of FIG. 2.
Figure 7B:
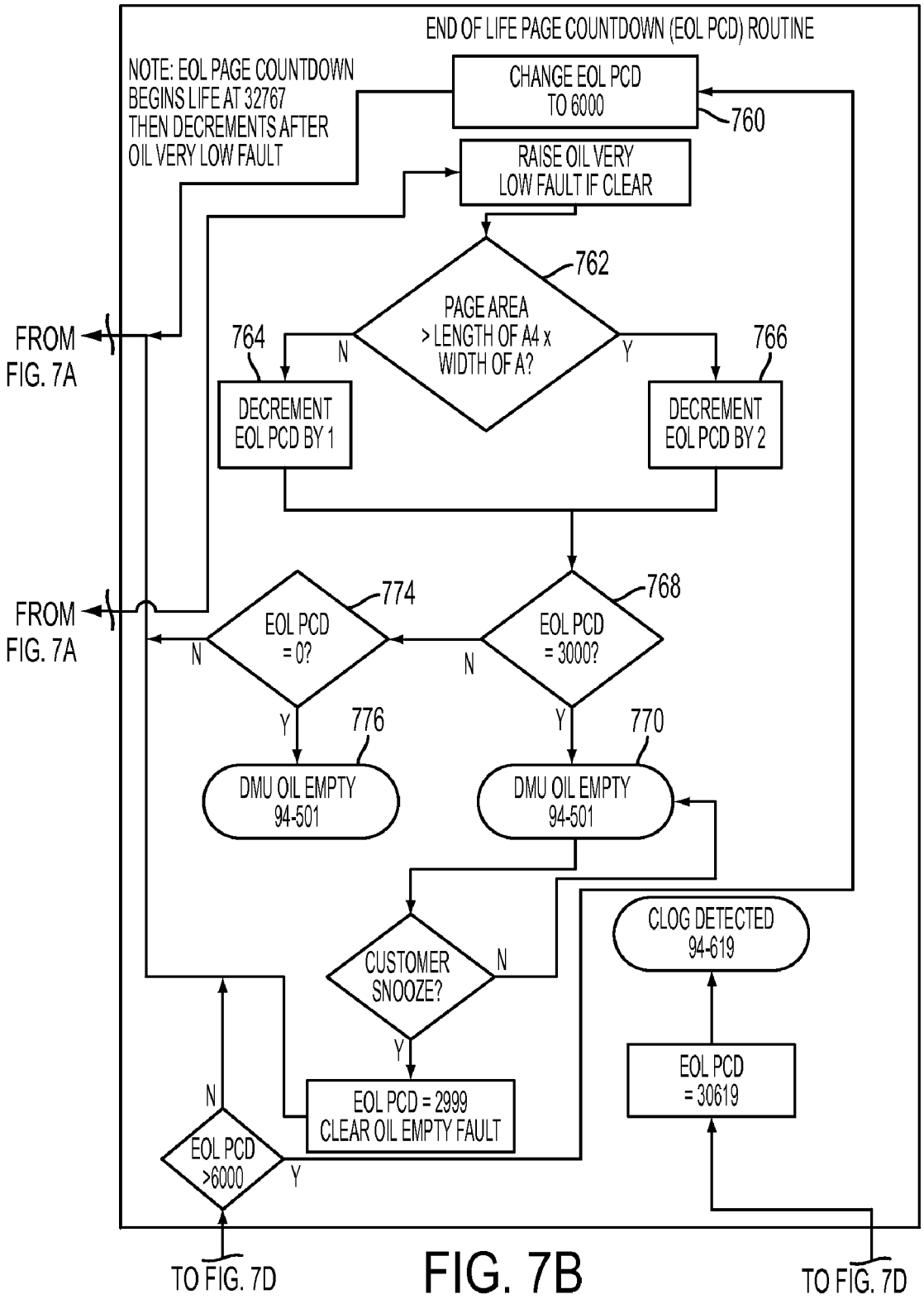
Figure 7C:
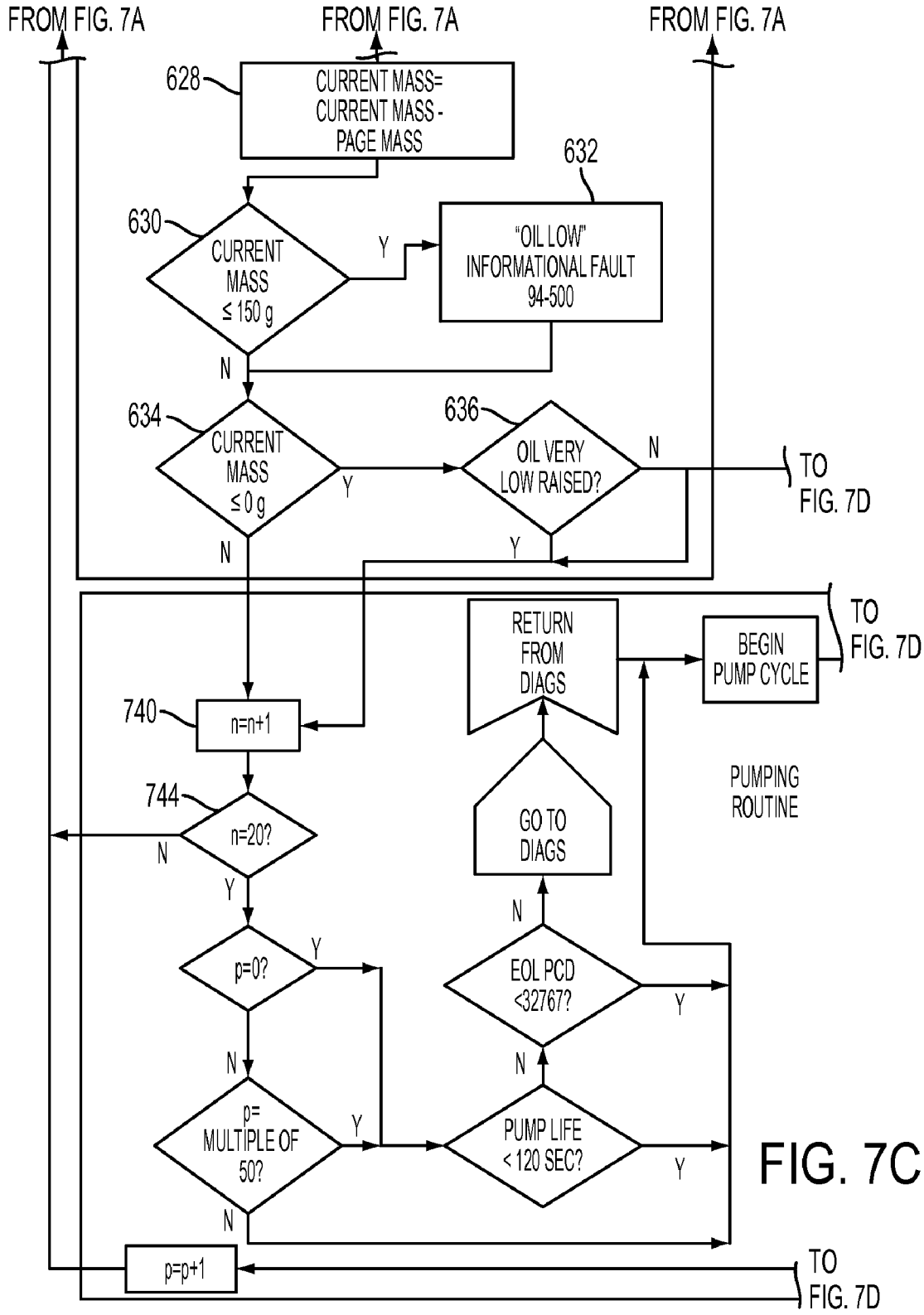
Figure 7D:
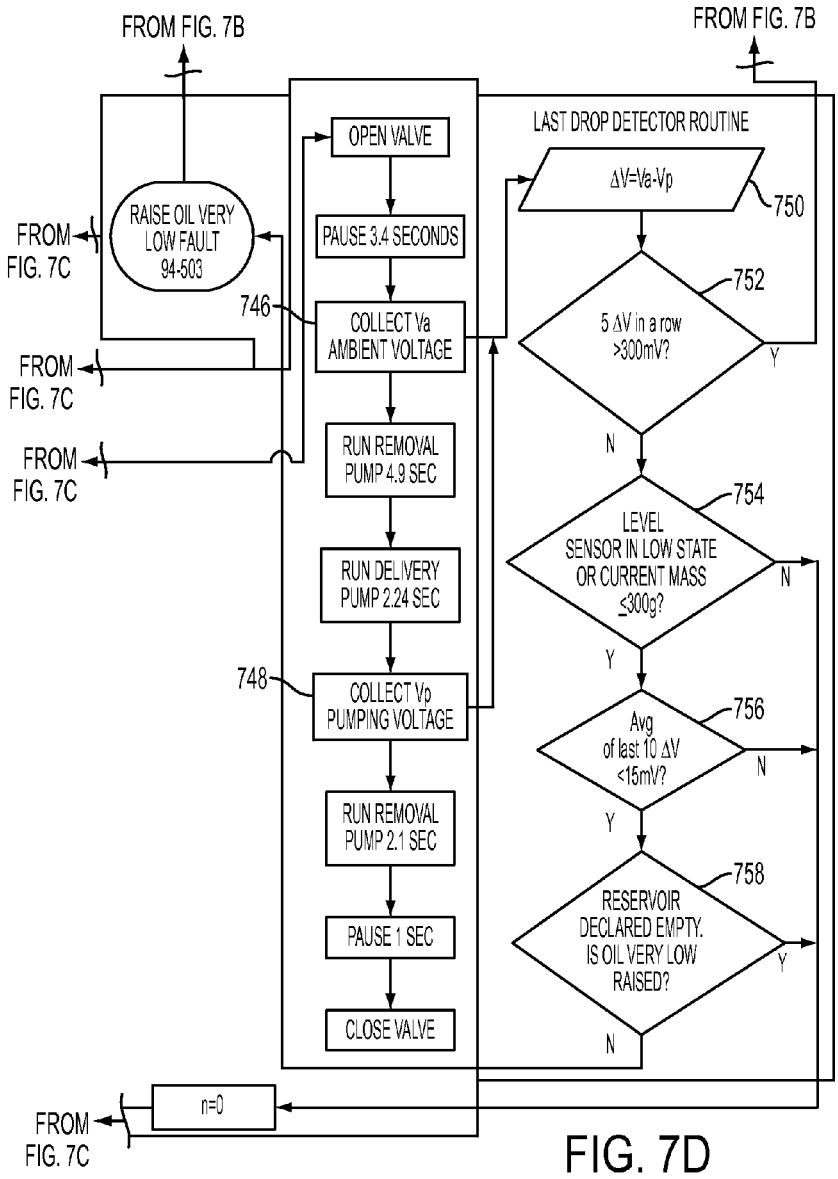

Referring to the flowchart of FIG. 7B, the end of life page countdown is a hard countdown which basically gives the customer 100 more pages until the DMU is declared empty. As mentioned, there is a field in the EEPROM for End Of Life Page Countdown. Each DMU is manufactured with a predetermined value (e.g., 32767) in this field. When the Oil Very Low fault is raised, the number changes to 6000 (block 760). For each print made, the EOL Countdown field is checked to determine whether the countdown value indicates that the Oil Very Low fault has been raised, e.g., the countdown is below 6001 (block 614). Thereafter, as always, the area of each printed page is measured (block 762). If the area is less than the length of an A4 sheet times the width of an A size sheet, one page is decremented (block 764), and if the area is greater, 2 pages are decremented (block 766). For example, an A or A4 sheet or smaller cause a decrement of one. A duplexed B or A3 size sheet causes a decrement of four. The number continues to decrease in this way until it reaches a value of, for example, 3000 (block 768). At that point, the Oil Empty fault is raised (block 770) and the customer gets a message to replace the DMU. In one embodiment, DMU operations may be allowed to continue for a predetermined number of pages, e.g., 100 pages. This feature may be configured for use in emergency situations when the customer is unexpectedly without a replacement DMU. Once the counter decrements to zero (block 774, FIG. 7B), the "Oil Empty" fault is again raised (block 776, FIG. 7B) and the DMU may be permanently disabled.

An alternative method for estimating current mass in the DMU involves inflating the reservoir using the sump pump and measuring the pressure difference. This could be done one of two ways—1) Run the pump for a given duration and measure the resulting change in voltage or 2) Run the pump until a given pressure difference is seen and measure how long it took. This concept can be explained analytically using the ideal gas law, a form of which is as follows: P=mRT/V. Where P=pressure, m=mass, R=constant, T=Temperature, V=Volume. In the case of running the pump for a set duration, m, R, and T are all constant. Mass can be considered constant because a peristaltic pump is a positive displacement pump. To be effective, the sump pump is essentially pumping only air. In that case, P=K/V, where K is a combined constant. It is shown that the more volume of compressible fluid (air) is in the essentially fixed volume of the reservoir, the less the pressure drop will be from running a pump a given duration (adding a given mass of air to the reservoir).

Figure 9:
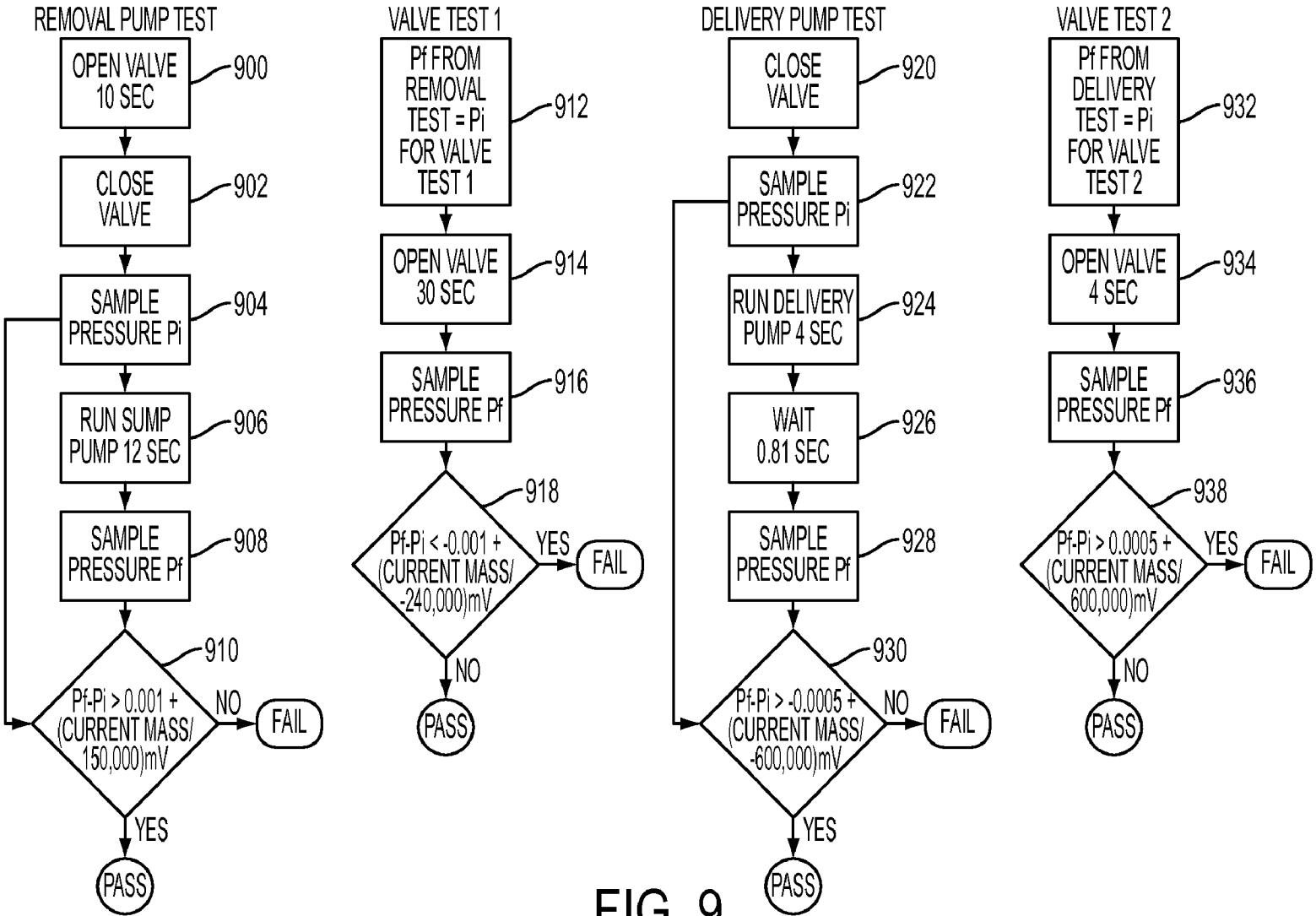
FIG. 9 is a flowchart of the diagnostic sub-tests of a diagnostic cycle for the DMU of FIG. 2.

In addition to the life sensing algorithm described above, the DMU may be configured to periodically run a diagnostic cycle to check the operation of the pumps 170, 174 and the solenoid valve 144. For example, in one embodiment, a diagnostic cycle may be run every 1000 pages printed. The diagnostic cycle includes a sequence of sub-tests for testing the functionality of the delivery pump 170, sump pump 184, and solenoid valve 144 of the DMU. The sequence of each of the individual sub-tests (e.g., sump pump sub-test, valve sub-test 1, delivery pump sub-test, and valve sub-test 2) are shown in the flow chart depicted in FIG. 9. According to the flowchart, during the sump pump sub-test, the solenoid valve is first opened to vent any pressure in the reservoir (block 900). The valve is then closed (block 902) and the sump pump is run (block 906). The pressure is checked before and after (blocks 904 and 908) using the pressure sensor. If the pump did not adequately increase the pressure (block 910), the sub-test has failed. The valve sub-test 1 is run using the final pressure value from the sump pump sub-test as the initial pressure value for the valve sub-test 1 (block 912). The solenoid valve is then opened (block 914) and the change in pressure is measured (916), if the opening of the valve did not adequately decrease the pressure (block 918), the sub-test has failed. The delivery pump sub-test is then run. During the delivery pump sub-test, the delivery pump is run (block 924) with the valve closed (block 920), and the pressure is checked using the pressure sensor before the delivery pump is run (block 922) and is checked again (block 928) after the pump is run and a 0.81 second wait time has elapsed (block 926). If the pump did not adequately reduce the pressure (block 930), the sub-test has failed. The valve sub-test 2 is run using the final pressure value from the delivery pump sub-test as the initial pressure value (block 932). The solenoid valve is then tested again by opening the valve (block 934) and measuring the change in pressure (block 936). If the opening of the valve did not adequately increase the pressure (block 938), the sub-test has failed. Note that in the pass or fail decision blocks of each sub-test (blocks 910, 918, 930, and 938), the failure limit is shown as an equation that is dependent on the current mass of oil in the reservoir. This is because the more oil that is in the reservoir, the higher the pressure change should be.

Figure 10:
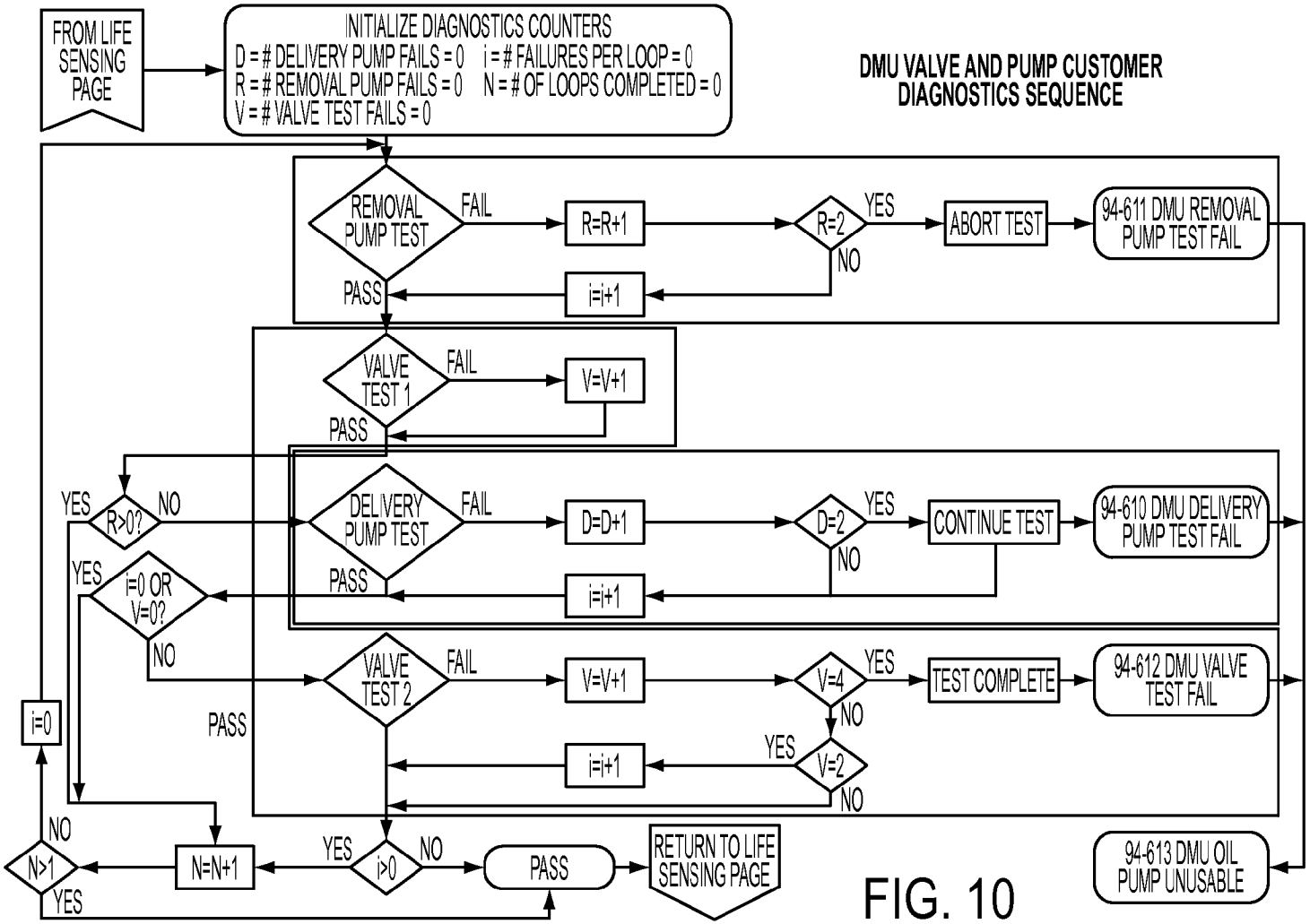
FIG. 10 is a flowchart of the diagnostic cycle for the DMU of FIG. 2.

Failing one of these sub-tests just once does not raise a fault. In order to prevent false failures, a sub-test must fail multiple times for a fault to be raised. FIG. 10 is a flowchart showing the sequence of a diagnostic cycle. According to the flowchart, if the sump pump or delivery pump fail, the entire cycle is run again. If the same test fails a second time, a fault is raised and the DMU is made unusable. If both valve tests 1 and 2 fail, the entire cycle is run again. If both valve tests fail again, a fault is raised and the DMU is made unusable. If the sump pump, valve 1 and delivery pump tests pass all pass in a round, valve test 2 is skipped in that round. If the sump pump ever fails, the delivery pump is not run. As described earlier with respect to the delivery pumping cycle, this prevents free oil in the DMU which can be a safety issue.

In addition to the diagnostic routines described above, reservoir pressure is constantly monitored via the pressure sensor for pressure "too high" or "too low" conditions when the reservoir should be at or near ambient pressure. Acceptable ranges of pressure are predetermined. If the pressure is between −1.5 and −3 psig for 1.6 seconds (4 ADC clock cycles), a reservoir pressure low fault is declared. If the pressure is less than −3, a fault is not declared. This implementation is intended to ignore spurious reservoir pressure low readings which may be caused by an intermittent circuit. If the pressure transducer circuit is open, the voltage drops to zero which corresponds to a pressure of about −6 or −7 psi which will not raise a reservoir pressure low fault. If the circuit remains continuously open, a diagnostics fault or a reservoir empty fault will eventually be raised. If the reservoir pressure is over +2 psig, for 1.6 seconds, a reservoir pressure high fault is raised.

Maintenance procedures may be performed on the DMU in the event of a fault such as the EOL countdown value being reached and/or failure of one or more of the diagnostic or life-sensing algorithms described above. Additionally, maintenance procedures may be performed periodically or on an as needed basis to check the status of the DMU and to promote reliable operation of the DMU. Maintenance procedures may be performed on unused DMUs prior to installation in an imaging device or may be performed on previously used DMUs that are to be installed in the same or a different imaging device.

Maintenance procedures may result in the replacement of the DMU with a different DMU, also referred to as a replacement DMU. As used herein, a "different" or "replacement" DMU may comprise may comprise new (i.e., previously unused) DMUs or may be DMUs that have been previously used in the same or another imaging device. For example, a "different" or "replacement" DMU may refer to a DMU removed from an imaging device in which one or more of the components of the DMU have been serviced, replaced, cleaned, or repaired prior to reinstalling the DMU in the imaging device.

Maintenance procedures may also include actions that are intended to extend the life of a DMU. For example, maintenance procedures for a DMU may include the cleaning and/or replacement of any or all of the components of the DMU described above including the DMU housing, applicator, metering blade, reservoir, sump, sump filter, delivery and recirculation pumps, flow lines, solenoid valve, pressure sensor, memory (i.e., EEPROM) and associated hardware such as supports, fasteners, and the like.

In addition, maintenance procedures may include the addition or replacement of the release agent in the DMU. Release agent may be replenished in a DMU by adding release agent to the reservoir in the DMU, by removing the reservoir and filling it with release agent, or by replacing the reservoir with a replacement reservoir that includes a supply of release agent. Maintenance procedures may also include the cleaning, repair, and/or replacement of one or both of the delivery and recirculation pumps, fluid lines, valves, and the like. Replacement components for use with a DMU may be unused or previously used components. For example, replacement components for a DMU may be newly manufactured or may be taken from another DMU. As used herein, replacement components for a DMU may also comprise components, parts, pieces, and the like from a DMU that are removed from and reinstalled in the same DMU.

Maintenance procedures may also include the repair, replacement, and or modification of the memory of the DMU, and, in particular, the operational data stored in the memory of a DMU. The operational data includes, for example, program code for implementing the diagnostic and life-sensing routines described above, operating values or parameters associated with the operation of the DMU such as the EOL countdown value (or any other type of value indicative of the remaining life of the DMU), pump drive voltages, flow rates, and the like. As part of a maintenance procedure, all or a portion of the operational data, such as the program code and, operating values in the memory of the DMU may be modified, replaced, overwritten, edited, and/or otherwise changed. Alternatively, the DMU memory may be removed and replaced with a replacement memory. The replacement memory may include the same or different operational data relative to the original DMU. The replacement memory may be loaded with operational data before or after being installed in a DMU.

In one embodiment, at least a portion of the housing may be removed in order to provide access to the components of the DMU to perform maintenance procedures, such as cleaning, repair, or replacement of one or more components of the DMU. Alternatively, access to the components of the DMU may be provided by removing an externally accessible component of the DMU, such as the applicator roller. Of course, some maintenance procedures may not require access to interior of the housing or removal of a portion of the housing to be performed, such as modification of the DMU memory and cleaning of the applicator roller.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of servicing a customer replaceable unit of an imaging device, the method comprising:

removing a customer replaceable unit from an imaging device, the customer replaceable unit (CRU) includes a housing in which drum maintenance unit (DMU) components are installed to enable the DMU components to be removed and installed in the imaging device as a self-contained unit, the DMU components installed in the housing including at least an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from a sump to the reservoir, and a memory including operational data for the customer replaceable unit;

performing a maintenance procedure on a DMU component of the customer replaceable unit after removal of the CRU from the imaging device; and installing the CRU into the imaging device after the maintenance procedure on the DMU component has been performed.

2. The method of claim 1, the performance of the maintenance procedure further comprising:

cleaning the applicator.

3. The method of claim 1, the performance of the maintenance procedure further comprising:

replacing the applicator with a replacement applicator.

4. The method of claim 1, the performance of the maintenance procedure further comprising:

adding release agent to the reservoir.

5. The method of claim 1, the performance of the maintenance procedure further comprising:

replacing the reservoir with a replacement reservoir, the replacement reservoir including a supply of release agent.

6. The method of claim 1, the performance of the maintenance procedure further comprising:

replacing the delivery pump in the customer replacement unit with a replacement delivery pump.

7. The method of claim 1, the performance of the maintenance procedure further comprising:

replacing the recirculation pump in the customer replacement unit with a replacement recirculation pump.

8. The method of claim 1, the performance of the maintenance procedure further comprising:

reading data from the memory.

9. The method of claim 1, the performance of the maintenance procedure further comprising:

writing data to the memory.

10. The method of claim 1, the performance of the maintenance procedure further comprising:

removing the memory from the housing; and adding a replacement memory to the housing.

11. The method of claim 10 wherein the replacement memory added to the housing of the customer replaceable unit includes operational data different than operational data stored in the removed memory.

12. The method of claim 10 wherein the replacement memory added to the housing of the customer replaceable unit includes operational data corresponding to operational data stored in the removed memory.

13. The method of claim 1, the installation of the CRU further comprising:

installing the DMU component on which the maintenance procedure was performed in the CRU before installing the customer replaceable unit in the imaging device.

14. The method of claim 1, the customer replaceable unit further comprising:

the sump being positioned to receive excess release agent from the reservoir, and the performance of the maintenance procedure further comprises:

cleaning or replacing the sump after removal of the CRU from the imaging device.

15. The method of claim 14, the sump further comprising a filter positioned to filter release agent prior to the release agent reaching the reservoir from the sump; and the performance of the maintenance procedure further comprises:

cleaning or replacing the filter of the sump after removal of the CRU from the imaging device.

16. The method of claim 1, the customer replaceable unit further comprising:

a metering blade for metering release agent applied to the drum by the applicator, and the performance of the maintenance procedure further comprises:

cleaning or replacing the metering blade after removal of the CRU from the imaging device.

17. The method of claim 1, the customer replaceable unit further comprising:

a valve for selectively venting air from the reservoir, and the performance of the maintenance procedure further comprises:

cleaning or replacing the valve after removal of the CRU from the imaging device.

18. The method of claim 1, the performance of the maintenance procedure further comprising:

removing the memory from the CRU;

modifying the operational data of the memory removed from the CRU;

installing the memory with the modified operational data in the CRU before installing the CRU in the imaging device.

19. A method of operating an imaging device, the method comprising:

removing a first drum maintenance unit from an imaging device, the first drum maintenance unit including an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from a sump to the reservoir, and a memory including operational data for the unit, the first drum maintenance unit being configured with a housing to enable removal of the applicator, the reservoir, the delivery pump, the recirculation pump, and the memory from the imaging device as a self-contained unit; and inserting a second drum maintenance unit into the imaging device, the second drum maintenance unit being different than the first drum maintenance unit, and the second drum maintenance unit being configured with a housing to enable removal of the second drum maintenance unit from the imaging device as a self-contained unit.

20. A method of maintaining a drum maintenance unit of an imaging device, the method comprising:

removing a drum maintenance unit from an imaging device, the drum maintenance unit comprising an applicator configured to apply a release agent to a surface of an intermediate transfer drum of the imaging device, a reservoir including a supply of the release agent for the applicator, a delivery pump configured to pump release agent from the reservoir to the applicator, a recirculation pump configured to pump release agent from a sump to the reservoir, and a memory including operational data for the drum maintenance unit, the drum maintenance unit being configured with a housing to enable removal of the applicator, the reservoir, the delivery pump, the recirculation pump, and the memory from the imaging device as a self-contained unit;

performing a maintenance procedure on at least one of the applicator, the reservoir, the delivery pump, the recirculation pump, and the memory; and installing the drum maintenance unit in the imaging device after the maintenance procedure has been performed.

* * * * *